United States Patent [19]

Hauck

[11] Patent Number: 4,525,936

[45] Date of Patent: Jul. 2, 1985

[54] FLUX DRYING APPARATUS AND METHOD

[76] Inventor: Günther Hauck, Ludwigstrasse 2, 4400 Munster, Fed. Rep. of Germany

[21] Appl. No.: 551,341

[22] Filed: Nov. 14, 1983

[51] Int. Cl.[3] ..... F26B 3/14

[52] U.S. Cl. ..... 34/33; 34/164; 34/171; 34/178; 34/184; 219/385; 219/388

[58] Field of Search ..... 34/33, 164, 171, 178, 34/184; 219/385, 388, 540

[56] References Cited

U.S. PATENT DOCUMENTS

| | | | |
|---|---|---|---|
| 694,958 | 3/1902 | Galshiot | 34/164 |
| 884,230 | 4/1908 | Spivak | 219/388 |
| 1,874,735 | 8/1932 | Barstow et al. | 34/33 |
| 2,717,458 | 9/1955 | Shabaker | 34/33 |
| 2,794,268 | 6/1957 | Louis et al. | 34/164 |
| 3,058,235 | 10/1962 | Morris et al. | 34/171 |
| 4,188,184 | 2/1980 | Fornoni | 34/171 |
| 4,223,452 | 9/1980 | Chambers | 34/171 |
| 4,339,306 | 7/1982 | Janusch | 34/171 |

*Primary Examiner*—Larry I. Schwartz
*Assistant Examiner*—David W. Westphal
*Attorney, Agent, or Firm*—Daniel E. McConnell

[57] ABSTRACT

An apparatus and method for drying welding flux in which flux to be dried is fed downwardly by gravity onto the uppermost of a vertically staggered, interleaved array of shelf plate support members within a drying chamber; and the drying chamber is swung about an axis generally parallel to the members while flux feeds downwardly by gravity from one to another of the members and while the flux is heated and dried.

23 Claims, 5 Drawing Figures

FLUX DRYING APPARATUS AND METHOD

FIELD AND BACKGROUND OF INVENTION

This invention relates to the drying of granular materials such as welding flux, and particularly to an apparatus and method for drying such flux.

It is known that fluxes fo submerged arc welding, and particularly those of the basic type, are hygroscopic. This is, the fluxes take up moisture from the ambient atmosphere during storage. As it is important for proper functioning of the fluxes that they be dry when used, technical specifications regarding the use of such fluxes prescribe drying of the fluxes before use so that the moisture content at use corresponds to that which was present when the flux was packaged by the manufacturer.

Redrying must be carefully done in order to avoid altering the granular characteristics of the flux. In accordance with certain procedures which have been specified heretofore, drying was accomplished in a drawer type oven at a temperature range between 250° and 400° Celsius for a time interval of two hours and with a maximum flux depth of 100 millimeters. After drying, the flux is to be held at a temperature of 150° Celsius. In these procedures, migration of moisture to the surface and diffusion from the granular flux requires substantial time and drying is thus relatively slow.

Alternate forms of ovens have been proposed in which granular material is fed downwardly through a hollow staft mounted at an angle or passed over heated plates or bars by vibration. In such ovens, drying conditions for the flux are often non-uniform and uncontrollable due to variations in depth of the flux material within the furnace. Further, the holding times of flux within the oven are relatively short, and it becomes difficult to dry a flux (particularly a more highly absorbtive one) to the original condition.

BRIEF DESCRIPTION OF INVENTION

With the foregoing discussion particularly in mind, it is an object of this invention to accomplish the drying of granular welding fluxes of the types described. In realizing this object of the present invention, such fluxes are dried in an apparatus and in accordance with a method in which the problems and deficiencies of the prior arrangements are avoided by providing for control over the feeding of flux undergoing drying downwardly by gravity.

Another object of this invention is to dry flux of the type described by feeding the flux downwardly by gravity from one plate to a lower plate, with the downward movement resulting from swinging movement of a chamber containing the plates and flux. With the swinging movement being controlled, the feeding of flux may be regulated to achieve desired depths of flux as drying proceeds. Further, the downward feeding from plate to plate results in a steady turning of the mass of flux undergoing drying, so as to facilitate release of moisture.

Yet a further object of this invention is to provide an apparatus for drying granular welding flux which has a drying chamber with a number of shelf plates mounted therewithin in a vertically staggered, interleaved array for receiving and supporting flux being dried, heaters for heating flux supported on the plates and thereby drying the flux, and an arrangement mounting the chamber for swinging movement about a horizontal axis generally parallel to the plates and driving the chamber in swinging movement for thereby feeding flux downwardly from one plate to a lower plate. By realizing this object of the present invention, the technical problems presented by the prior drying ovens mentioned above are overcome.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
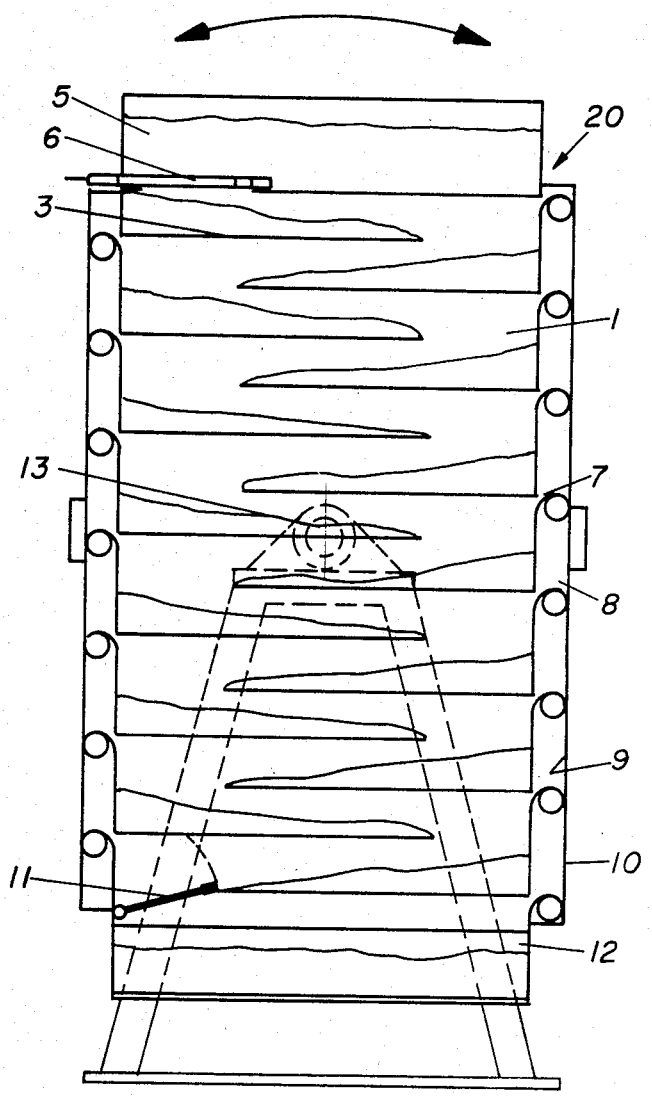
FIG. 1 is an elevation view in section of a first form of apparatus in accordance with the present invention.

Referring now more particularly to the drawings, where a number of forms of apparatus in accordance with this invention are shown, a first form of apparatus in accordance with this invention is shown in FIG. 1 and there generally identified by the reference character 20. In the description which follows, common reference characters are used throughout to identify common structural features of the various forms of the apparatus of this invention. Thus, in the apparatus 20, provision is made for a drying chamber means 10 defining a chamber 1 for containing flux to be dried. The chamber means 10 has a plurality of shelf plate means 3 mounted therewithin in a vertically staggered, interleaved array for receiving and supporting flux being dried. In the apparatus 20, the chamber means 10 has side walls from which the shelf plates 3 extend as defined more fully hereinafter. As will be noted, the uppermost shelf plate 3 extends from one side of the chamber 1, while the next lowermost shelf plate extends from the opposite side, and the next lowermost extends from the same side as the uppermost. Adjacent plates are spaced vertically one from another, so as to provide a separation therebetween. Each plate 3 extends from its respective side wall for a distance greater than one half the width of the chamber 1. It is these relationships which are intended to be defined by the reference to the plates as being in a vertically staggered, interleaved array.

In order to accomplish feeding a flux through the drying chamber in accordance with the objects of this invention, means are provided for mounting the chamber means 10 for swinging movement about a horizontal axis. In the apparatus 20, the axis is defined by an aligned pair of stub shafts 13, positioned approximately at the center of gravity of the chamber means 10. As will be noted, the axis bears particularly relationships to the side walls and shalf plates of the chamber means 10. More particularly, the side walls are generally parallel to the axis, as are the plates. The chamber means 10 has end walls which are generally perpendicular to the axis. The means for mounting the chamber means 10 also, by means of a suitable motive means such as an electrical motor and transmission, drives the chamber in swinging movement. As will be appreciated from FIG. 1, where quantities of flux are indicated as being on the plates 3, such pendulum like swinging movement feeds flux downwardly by gravity from one plate to a lower plate. This is, as the chamber 10 swings to one side so that the plates extending from the upper side wall tip downwardly toward the other side wall, flux spills from those plates downwardly onto the underlying plates. Then, as the chamber swings to the opposite side, flux spills downwardly to the next lower plate. Flux thus moves gradually downwardly within the chamber 1 and is turned or agitated as it moves downwardly. Such turning or agitation aids significantly in drying of the flux.

In order to accomplish drying, heater means are provided for heating flux supported on the plates 3 and thereby drying the flux. It is contemplated that the heater means may take a wide variety of forms, ranging from external means for delivering heated air into and through the chamber 1 to heater devices mounted within the chamber. The preferred form is electrical resistance heaters operatively associated with the shelf plates 3 for heating the plates, and thereby heating the flux.

In order to accomplish orderly feeding of flux into and through the apparatus 20, means are provided defining a feed chamber 5 and a holding chamber 12.

The feed chamber 5 receives and contains quantities of flux to be dried, and feeds flux downwardly onto the uppermost shelf plate 3 within the drying chamber means 10. In the apparatus of FIG. 1, the feed chamber 5 is mounted on or integral with the drying chamber means and moves with that means in its swinging movement as described hereinabove. A flux flow control means, shown in the form of a slide plate 6, is interposed between the feed chamber 5 and the drying chamber 1 for controlling the rate of flow of flux onto the shelf plate and thence through the apparatus 20.

The means defining the holding chamber 12 receives and contains flux which has been dried and delivered downwardly by gravity from the lowermost of the shelf plates 3. The holding chamber assists in assuring that flux, once dried, remains in the desired dry state until removed from the apparatus 20 for use. To that end, closure means, shown in the form of flaps 11, are provided for closing the holding chamber 12. The flaps 11 are mounted for movement in response to swinging movement of the chamber means 10 for opening the chamber 12 to receive dried flux and closing the chamber to retain flux received.

If desired, and in order to assure proper grading of the flux being dried, the apparatus 20 may have sieve means operatively associated with at least certain ones of the shelf plates for separating flux being processed by granule size. Thus fine particles which might interfere with proper flux function may be removed during the drying process.

As will be appreciated, appropriate controls may be provided for the temperature attained in the drying chamber 1 and in the holding chamber 12. Additionally, the drive means by which swinging movement of the chamber means 10 is accomplished my similarly be controlled with respect to the extent, speed and duration of swinging movement, thus opening a number of different control variables to assist in assuring that a variety a types of flux may be properly processed.

In order to remove from the drying chamber 1 the moisture and/or other fumes released from the flux during drying, vent means are provided in the chamber means 10. The vent means, as shown in FIG. 1, includes slots 7 formed adjacent the side wall ends of the shelf plates 3 and vertical passageways 8 immediately adjacent the inner surfaces 9 of the sidewalls.

The apparatus 20 described to this point may be used in at least two ways in practicing the flux drying methods of the present invention. First, the apparatus may be operated on an essentially continuous, flow through, basis. In such operation, swinging movement of the apparatus is stopped only when necessary to remove or supply flux. That is, the movement is interrupted only when either the feed chamber 5 becomes empty or the holding chamber 12 becomes full. Second, the apparatus may be operated on a discontinuous basis. In such operation, swinging movement begins, is continued until such time as the charge of flux being dried is well distributed among the shelf plates within the chamber 1, and is then interrupted for a timed duration. During the timed duration, heating continues so that drying occurs with the flux being held on the shelves. After the timed interval, swinging is resumed to unload the flux from the apparatus into the holding chamber 12.

Figure 2:
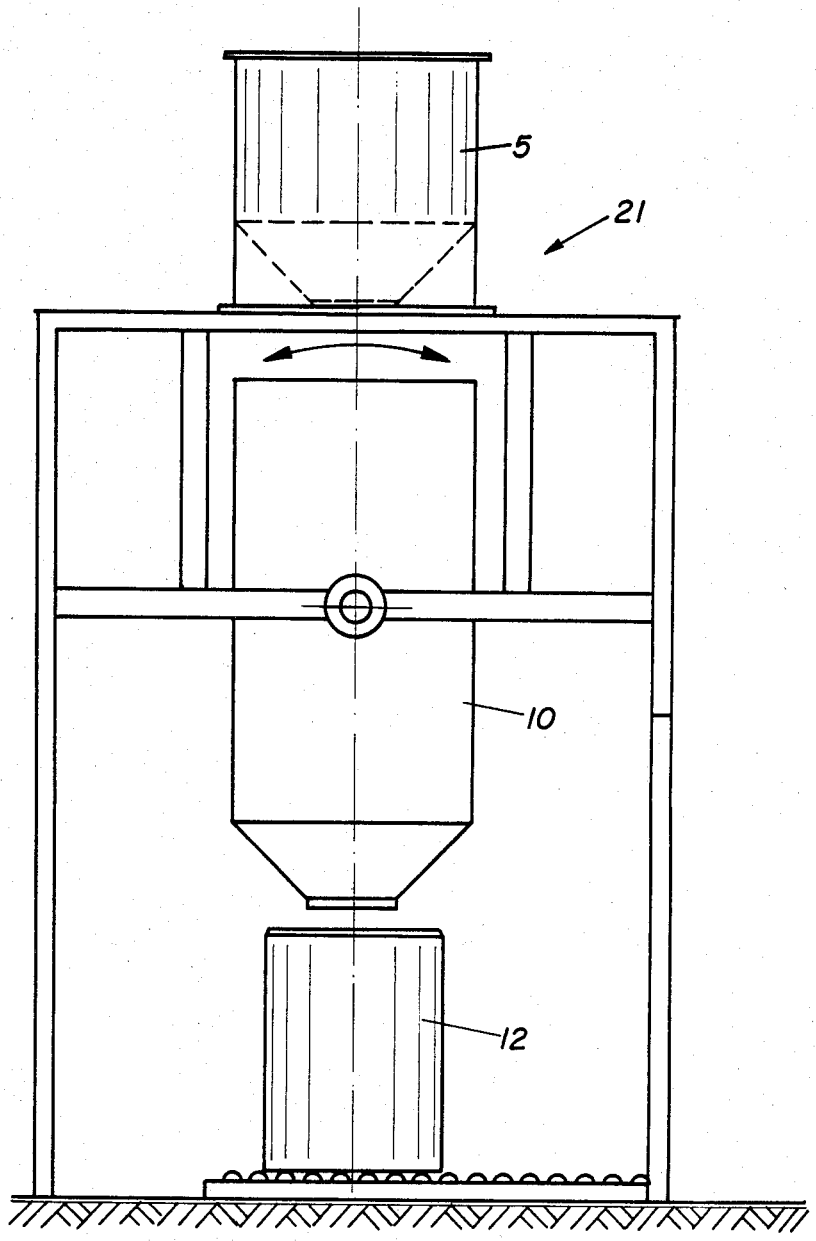
FIG. 2 is an elevation view of a second form of apparatus in accordance with this invention.

Referring now more particularly to the form of apparatus shown in FIG. 2, it will be noted that the structural features and operation of the apparatus generally indicated at 21 are substantially the same as those described above with reference to the apparatus of FIG. 1. Accordingly, and in the interests of brevity, the general description applicable to both forms of the invention will not be repeated. Instead, attention will be directed to the differences between the two forms.

In particular, the apparatus 21 of FIG. 2 has the feeding chamber means 5 and holding chamber means 12 mounted stationarily relative to the swinging drying chamber means 10. In some instances, such arrangements may be preferred.

Figure 3:
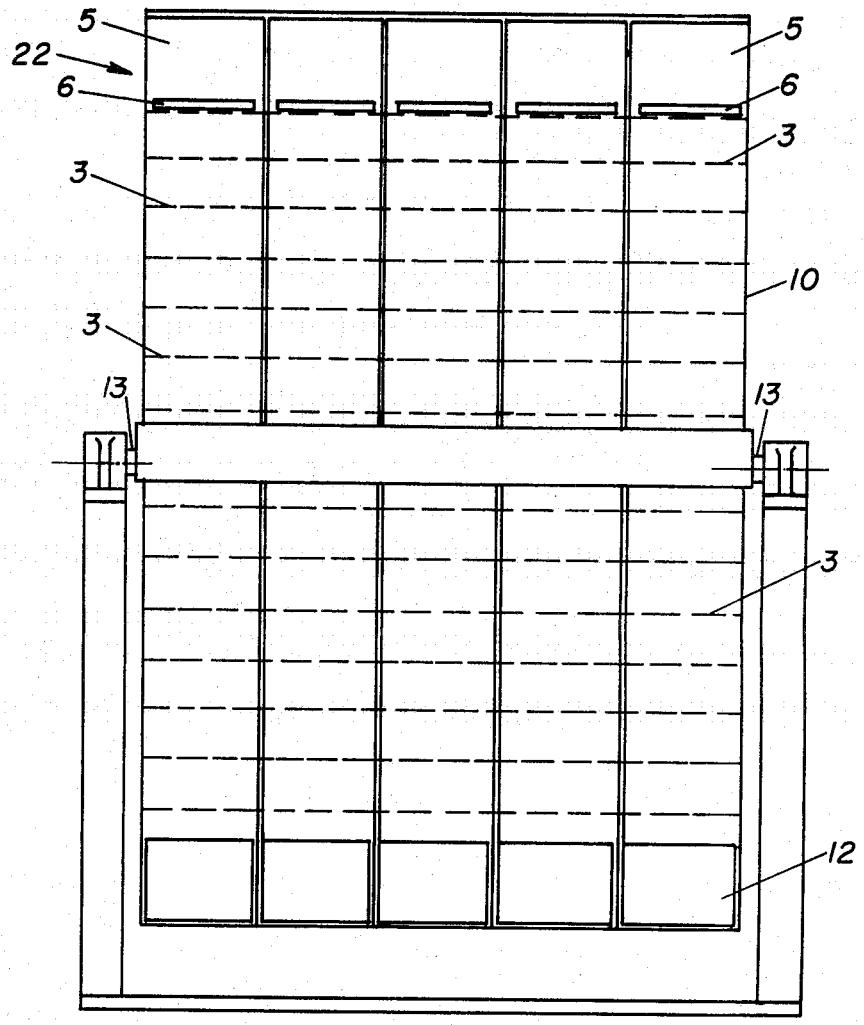
FIG. 3 is a vertical section view of an apparatus similar to that of FIG. 1, taken perpendicularly to the view of FIG. 1.

The apparatus of FIG. 3, indicated generally at 22 and described in a manner similar to the above description of the apparatus 21 of FIG. 2, is a multiple chamber apparatus. In the multiple chamber apparatus, either a plurality of different fluxes may be dried simultaneously, or a plurality of different charges of the same flux may be processed in parallel.

Figure 4A:
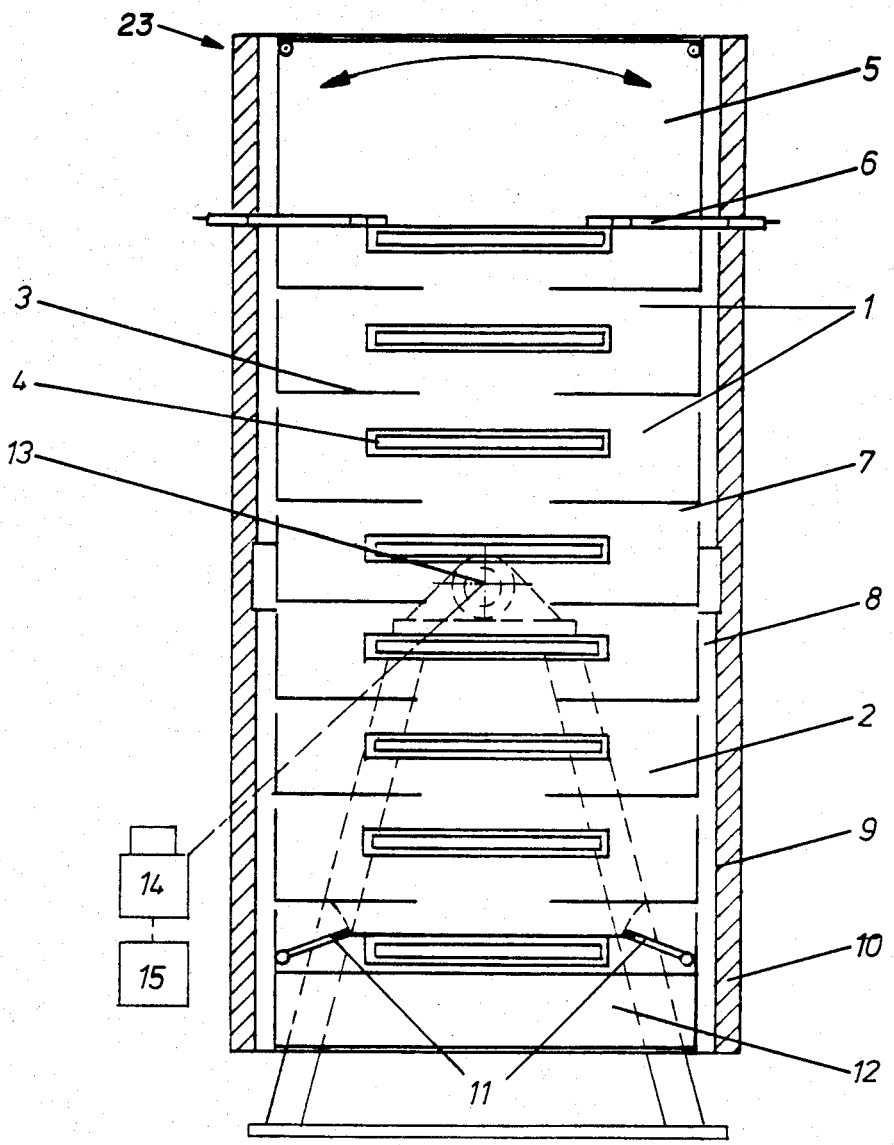
FIG. 4*a* is a view similar to FIG. 1, showing another form of apparatus in accordance with this invention.
Figure 4B:
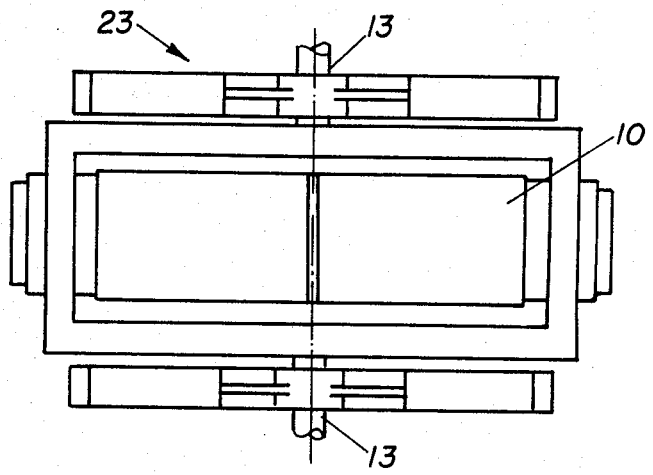
FIG. 4*b* is a plan view of the apparatus of FIG. 4*a*.

The apparatus of FIGS. 4*a* and 4*b*, generally indicated at 23 and described in a manner similar to the above description of the apparatus 21 of FIG. 2, differs from the other forms described in the arrangement of the shelf plates provided. In the arrangement of the apparatus 23, the shelf plates include center plates 4 extending between the end walls of the chamber means 10 and side plates 3 extending from the side walls. The side plates 3 are arranged in aligned, opposing pairs, each of which extends for a distance less than one half the width of the chamber. The center plates are vertically spaced from adjacent pairs of side plates, and have a width such as to at least span the space separating the side plates of an adjacent, aligned, opposing pair. Thus, the vertically staggered, interleaved array of the plates differs from those described above. However, the characteristic feature of stepwise downward feeding of flux by gravity and in response to the swinging movement of the chamber is retained. In the apparatus 23 of FIGS. 4*a* and 4*b*, which is the preferred form for the apparatus of this invention, the electrical resistance heaters are contained within the center plates 4, and the drive means 14 and control means 15 are indicated schematically.

In the drawings and specifications there has been set forth a preferred embodiment of the invention and, although specific terms are used, the description thus given uses terminology in a generic and descriptive sense only and not for purposes of limitation.

That which is claimed is:

1. Apparatus for drying granular welding flux and comprising:

drying chamber means defining a chamber for containing flux to be dried and having a plurality of shelf plate means mounted in a vertically staggered, interleaved array therewithin for receiving and supporting flux being dried, heater means for heating flux supported on said plate means and thereby for drying the flux, means for mounting said chamber means for pendulous swinging movement about a horizontal axis, means for controllably driving said chamber means in pendulous swinging movement and thereby for tipping said shelf plate means downwardly toward others of said shelf plate means for spilling flux downwardly by gravity flow from one of said shelf plate means to a lower one of said shelf plate means, and means operatively connected to said drive means for periodically interrupting the pendulous swinging movement of said chamber means and thereby for holding the flux on said shelf plate means during drying and until such time as the pendulous swinging movement is resumed.

2. Apparatus according to claim 1 wherein said chamber means has side walls generally parallel to said axis, and further wherein said shelf plate means extend from said side walls generally parallel to said axis, adjacent ones of said plate means extending from opposite side walls for a distance greater than one half the width of said chamber.

3. Apparatus according to claim 1 wherein said chamber means has side walls generally parallel to said axis and end walls generally perpendicular to said axis, and further wherein said shelf plate means comprises center plates extending between said end walls and generally parallel to said axis and side plates extending from said side walls and generally parallel to said axis, said side plates being arranged in aligned, opposing pairs each of which extends for a distance less than one half the width of said chamber, and said center plates being vertically spaced from adjacent pairs of said side plates and extending for a widthwise distance which at least spans the space separating the side plates of an adjacent, aligned, opposing pair.

4. Apparatus according to claim 3 wherein said heater means comprises a plurality of electrical resistance heater means operatively associated with said center plates for heating said center plates and thereby heating the flux.

5. Apparatus according to claim 1 further comprising means defining a feed chamber for receiving and containing a quantity of flux to be dried and for feeding flux downwardly onto an uppermost one of said shelf plate means.

6. Apparatus according to claim 5 further comprising adjustable flux flow control means interposed between said feed chamber and said uppermost shelf plate means for controlling the rate of flow of flux onto said shelf plate means.

7. Apparatus according to one of claim 5 or claim 6 wherein said feed chamber means is stationarily mounted above said drying chamber means.

8. Apparatus acccording to one of claim 5 or claim 6 wherein said feed chamber means is mounted on and above said drying chamber means for movement therewith.

9. Apparatus according to claim 1 further comprising means defining a holding chamber for receiving and containing a quantity of flux which has been dried and delivered downwardly by gravity from a lowermost one of said shelf plate means.

10. Apparatus according to claim 9 further comprising closure means for closing said holding chamber and mounted for movement in response to swinging movement of said drying chamber means for opening to admit dried flux and closing to retain dried flux.

11. Apparatus according to claim 1 wherein said heater means comprises a plurality of electrical resistance heating elements mounted within said drying chamber.

12. Apparatus according to claim 11 wherein said plurality of electrical resistance heater elements are operatively associated with said shelf plate means for heating said plate means and thereby heating the flux.

13. Apparatus according to claim 1 further comprising means for controlling the temperature attained by said heating means and thereby controlling the drying of the flux.

14. Apparatus acording to claim 1 further comprising vent means for venting from said drying chamber means vapor resulting from drying of the flux.

15. Apparatus for drying granular welding flux and comprising:

drying chamber means defining a chamber for containing flux to be dried and having a plurality of shelf plate means mounted in a vertically staggered, interleaved array therewithin for receiving and supporting flux being dried, means defining a feed chamber for receiving and containing a quantity of flux to be dried and for feeding flux downwardly onto an uppermost one of said shelf plate means, a plurality of electrical resistance heater means mounted within said drying chamber means for heating flux supported on said plate means and thereby for drying the flux, means defining a holding chamber for receiving and containing a quantity of flux which has been dried and delivered downwardly by gravity from a lowermost one of said shelf plate means, means for mounting said chamber means for swinging movement about a horizontal axis, means for controllably driving said chamber means in pendulous swinging movement and thereby for tipping said shelf plate means downwardly toward others of said shelf plate means for spilling flux downwardly by gravity flow from one of said shelf plate means to a lower one of said shelf plate means, and means operatively connected to said drive means for periodically interrupting the pendulous swinging movement of said chamber means and thereby for holding the flux on said shelf plate means during drying and until such time as the pendulous swinging movement is resumed.

16. Apparatus according to claim 15 wherein said chamber means has side walls generally parallel to said axis, and further wherein said shelf plate means extend from said side walls generally parallel to said axis, adjacent ones of said plate means extending from opposite side walls for a distance greater than one half the width of said chamber.

17. Apparatus according to claim 15 wherein said chamber means has sidewalls generally parallel to said axis and end walls generally perpendicular to said axis, and further wherein said shelf plate means comprises center plates extending between said end walls and generally parallel to said axis and side plates extending from said side walls and generally parallel to said axis, said side plates being arranged in aligned, opposing pairs each of which extends for a distance less than one half the width of said chamber, and said center plates being vertically spaced from adjacent pairs of said side plates and extending for a widthwise distance which at least spans the space separating the side plates of an adjacent, aligned, opposing pair.

18. Apparatus according to claim 15 further comprising adjustable flux flow control means interposed between said feed chamber and said uppermost shelf plate means for controlling the rate of flow of flux onto said shelf plate means.

19. Apparatus according to claim 15 wherein said feed chamber means is stationarily mounted above said drying chamber means.

20. Apparatus according claim 15 wherein said feed chamber means is mounted on and above said drying chamber means for movement therewith.

21. Apparatus according to claim 15 further comprising closure means for closing said holding chamber and mounted for movement in response to swinging movement of said drying chamber means for opening to admit dried flux and closing to retain dried flux.

22. A method of drying welding flux comprising feeding flux to be dried downwardly by gravity onto an uppermost one of a vertically staggered, interleaved array of shelf plate support members within a drying chamber; swinging the drying chamber about an axis generally parallel to the members while feeding flux downwardly by gravity from one to another of the members and while heating and drying the flux; periodically interrupting the swinging of the drying chamber; heating and drying the flux while the swinging is interrupted; and then resuming the swinging of the drying chamber; and feeding the dried flux downwardly by gravity from a lowermost one of the members.

23. A method according to claim 22 wherein the steps of feeding flux to be dried and feeding dried flux are performed at the same time.

* * * * *